US005088694A

United States Patent [19]

Nishimura

[11] Patent Number: 5,088,694

[45] Date of Patent: Feb. 18, 1992

[54] LEVER TYPE HOIST

[75] Inventor: Yosaku Nishimura, Hirakata, Japan

[73] Assignee: Vital Kogyo Kabushiki Kaisha, Osaka, Japan

[21] Appl. No.: 672,109

[22] Filed: Mar. 19, 1991

[30] Foreign Application Priority Data

Oct. 19, 1990 [JP] Japan ..... 2-282669

[51] Int. Cl.[5] ..... B66D 1/14

[52] U.S. Cl. ..... 254/352; 254/372; 74/575; 74/523

[58] Field of Search ..... 74/505, 523, 575, 572 M; 254/352, 365, 369, 372

[56] References Cited

U.S. PATENT DOCUMENTS 4,469,308 9/1984 Nakamura et al. ..... 254/352 X
4,474,360 10/1984 Maeda ..... 254/372 X
4,768,754 9/1988 Nishimura ..... 254/352 X

*Primary Examiner*—Dirk Wright
*Attorney, Agent, or Firm*—Mason, Fenwick & Lawrence

[57] ABSTRACT

A lever type hoist the lower hook of which can be positionally adjusted with a continuous lowering of the load chain on the end side under the no-load condition. In a structure in which the load sheave becomes freely rotatable by moving the presser drive member to the operating wheel side to separate it from the pressure receiving member, the conical frictional member connectable with the presser drive member in the direction of rotation and the operating wheel connected by spline to the drive shaft in proximity to the conical frictional member are provided at opposed ends with connecting parts which are mutually connectable in the direction of rotation, those connecting parts being connected with each other at the time of free rotation of the load sheave, thus effectively preventing the rotational force transmitting member which transmits the operating force of the operating lever to the presser drive member from getting in contact with other component members to maintain a continuous and smooth free rotation of the load sheave.

8 Claims, 4 Drawing Sheets

LEVER TYPE HOIST

BACKGROUND OF THE INVENTION

1. Field of the Invention

This invention relates to a lever type hoist. To be more specific, this invention relates to a lever type hoist designed to prohibit hoisting of load when any load heavier than the approved rated load is hung on it. Moreover, this invention relates to a lever type hoist allowing continuous lowering of the load chain on the end side to which the lower hook is not connected, under the no-load condition. Furthermore, this invention relates to a lever type hoist which enables smooth positional adjustment of the lower hook with a small force.

2. Description of the Prior Art

Conventionally, either of the following methods was adopted to make a positional adjustment of the lower hook by moving it in the direction of height by pulling the load chain mounted on the load sieve in a lever type hoist under the no-load condition:

(1) Moving the drive shaft to the operating wheel side to release the connection between the pinion fixed to one end of the drive shaft concerned and the geared transmission system which transmits rotation to the load sieve and enable free rotation of the load sieve and pulling the load chain in the state of free rotation.

(2) Moving the presser drive member to the operating wheel side to separate it from the pressure receiving member to enable free rotation of the load sieve and pulling the load chain in the state of free rotation.

However, those methods presented problems as described hereunder and improvement of the methods was strongly desired.

Namely, in the method (1) above, the braking force applied at the time of free rotation to the load sieve disconnected from the drive shaft side diminished. For that reason, in case the connection between the drive shaft and the load sieve is released during the work, the load sieve gets in the state of free rotation, presenting a risk of accident with unexpected falling of baggage or loosening of tightened baggage. There was also a danger that, in the state where the connection between the drive shaft and the load sieve is released, the speed of moving the lower hook by pulling the load chain gets faster than the expectation of the worker, causing an unexpected accident to the worker. In addition, when lifting up or down the next baggage, it was necessary to move the drive shaft disconnected from the load sieve side at the time of free rotation to the geared transmission system side while turning it and engage the pinion fixed to one end of the drive shaft concerned with the geared transmission system.

In the method (2) above, if you make a positional adjustment of the lower hook in the direction of height under the no-load condition, the rotation of the load sieve becomes heavy, making it impossible to make the adjustments continuously with a small force. For that reason, each time when the rotation of the load sieve became heavy, it was necessary to repeat the troublesome operation of loosening the presser drive member by manipulating the operating lever. The inventor thoroughly investigated into the cause of heavy rotation of the load sieve and found that the presser drive member moved in the direction of separating from the pressure receiving member gets in contact with either the external cover of the operating lever or other components and that this contact frictional force prevents the free rotation of the load sieve.

BRIEF SUMMARY OF THE INVENTION

This invention, which has been realized in view of those problems of the conventional methods, has the main object of providing a lever type hoist equipped with a limit load mechanism capable of solving the above problems and performing free rotation of the load sieve continuously and smoothly with a small force.

Another object of this invention is to provide a lever type hoist capable of performing positional adjustment in the direction of height of the lower hook safely without releasing the connection between the pinion of the drive shaft and the load sieve under the no-load condition.

Still another object of this invention is to provide a lever type hoist having a structure in which the presser drive member does not get in contact with the external cover of the operating lever or other components when the presser drive member is moved to the operating wheel side.

The above objects and other related objects and characteristics of this invention will become apparent with a perusal of the detailed description based on the attached drawings and the novelties pointed out in the claims.

DETAILED DESCRIPTION OF THE PREFERRED EMBODIMENT

An example of this invention will be described hereunder based on the drawings.

Figure 1:
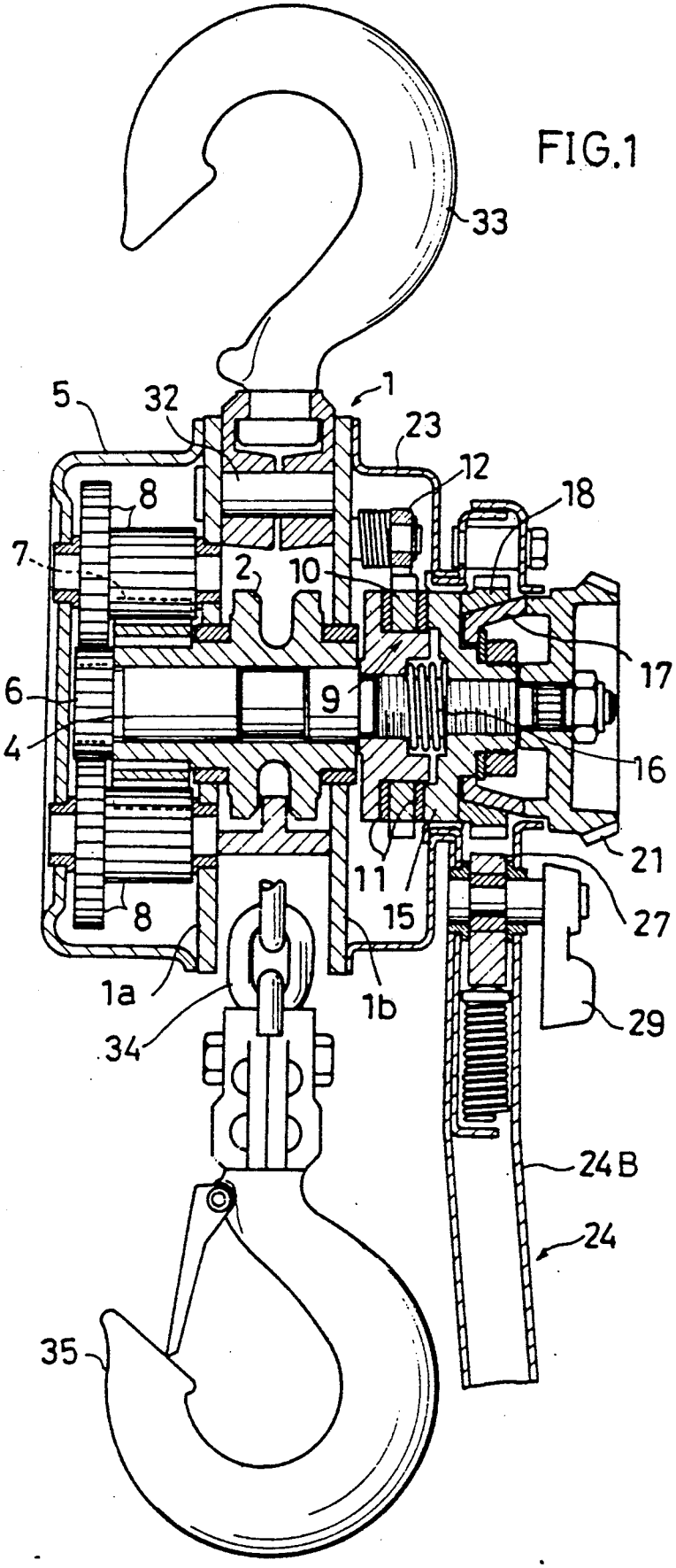
FIG. 1 is a longitudinal sectional view indicating a lever type hoist which is an example of this invention.
Figure 2:
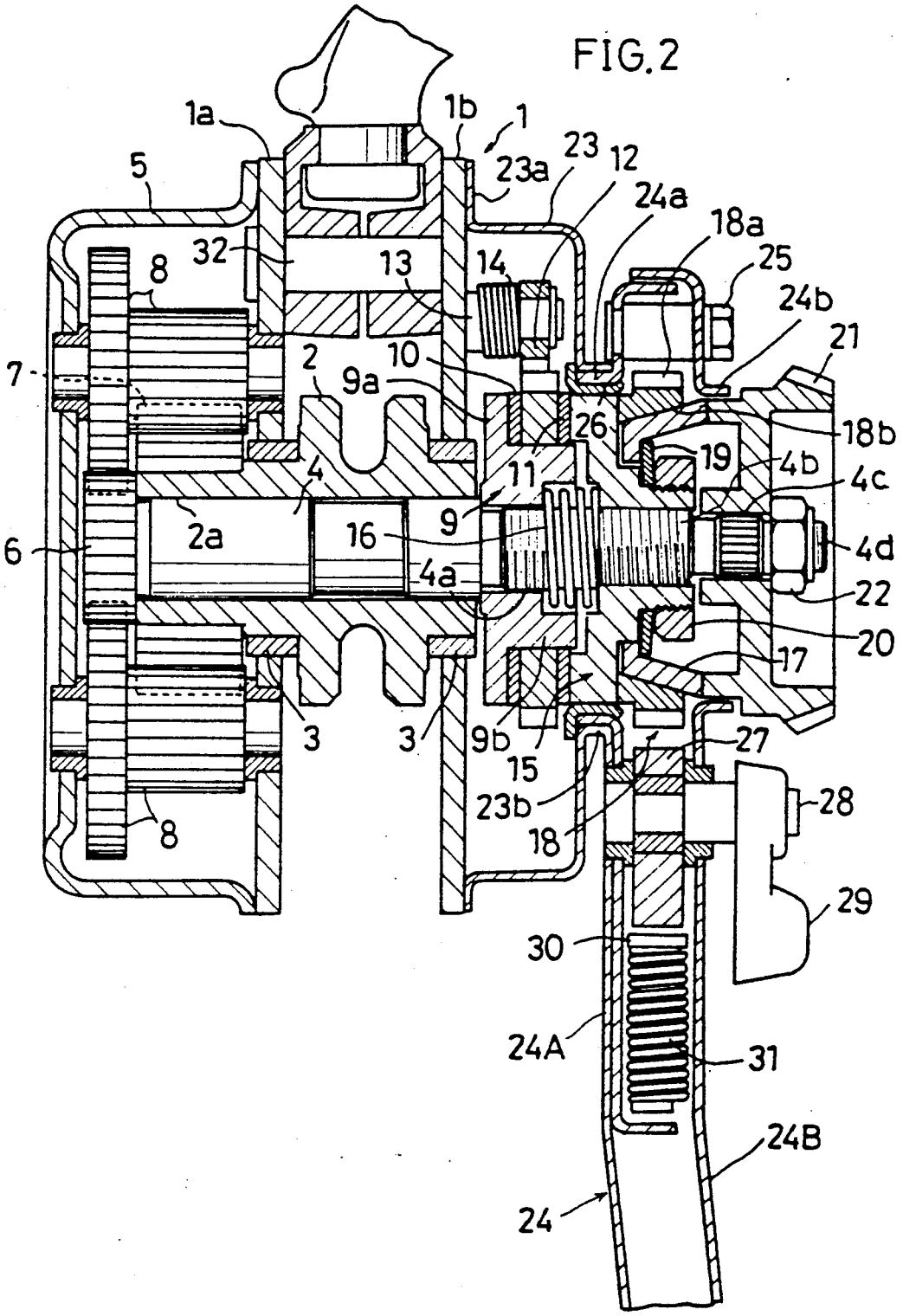
FIG. 2 is a longitudinal sectional view indicating an expanded view of the main part of the lever type hoist.
Figure 3:
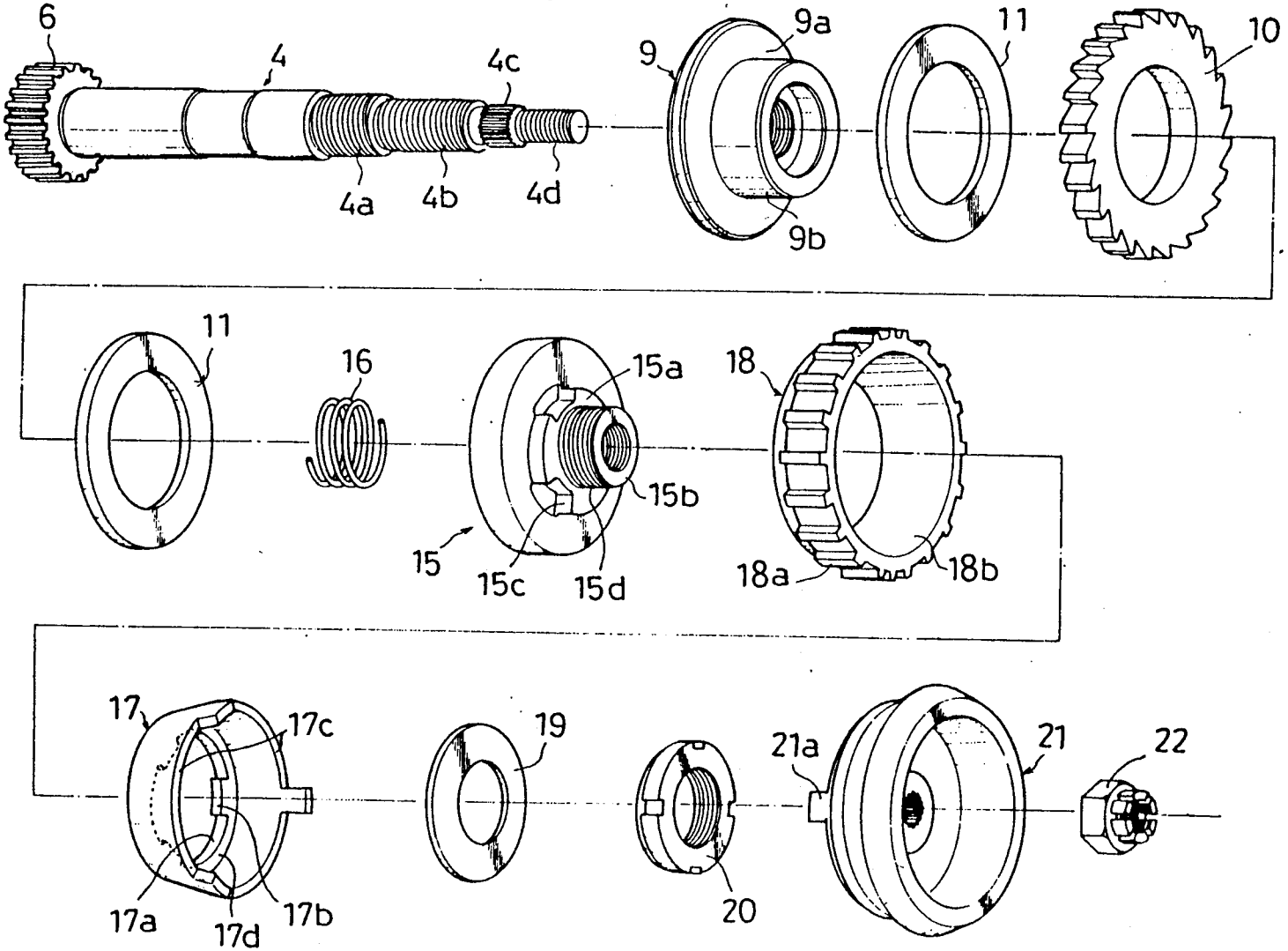
FIG. 3 is a perspective diagram indicating a disassembled view of the main parts of the lever type hoist.
Figure 4:
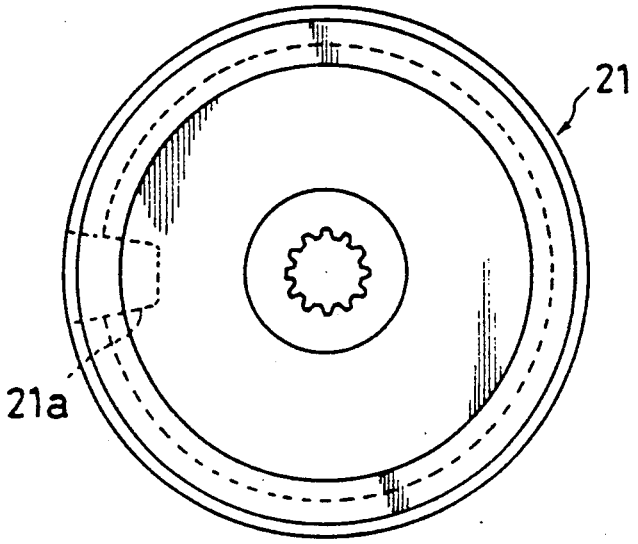
FIG. 4 is a front elevation indicating the operating wheel of the lever type hoist.
Figure 5:
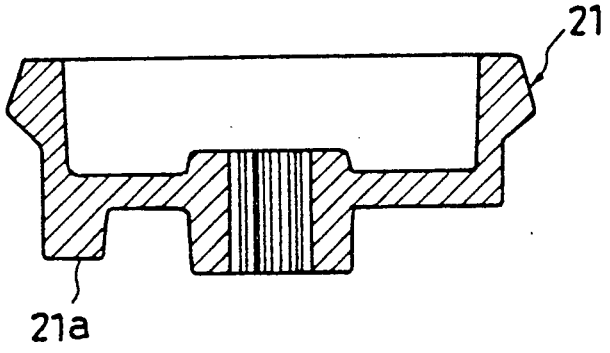
FIG. 5 is a traverse sectional view of the operating wheel.

FIG. 1 and FIG. 2 indicate a lever type hoist of this invention. This lever type hoist is provided with a hoist body 1 constituted by a pair of parallel side plates 1*a*, 1*b* and a load sheave 2 held rotatably between those side plates 1*a*, 1*b* by bearings 3, 3. The load sheave 2 has a shaft hole 2*a* provided along its axis and a drive shaft 4 inserted in that hole. On the outside of one side plate 1*a*, a gear case 5 is mounted and one end of the drive shaft 4 protrudes into the gear case 5. The other end of the drive shaft 4 protrudes to outside of the other side plate 1*b*.

The transmission of rotation between the drive shaft 4 and the load sheave 2 is performed by connecting a pinion 6 and a gear 7 through a geared transmission system 8. The pinion 6 is fixed to one end of the drive shaft 4 and the gear 7 is fixed to the shaft part of the load sheave 2. The geared transmission system 8 is constituted by a plural number of gears which are rotatably supported by shaft between the side plate la and the gear case 5.

On the drive shaft 4 protruding to outside of the side plate 1*b*, the first right-handed screw 4*a* and the second right-handed screw 4*b* are formed in succession from the side closer to the side plate 1*b*. The first right-handed screw 4*a* is screw connected and fixed with a pressure receiving member 9 while the second right-handed screw 4*b* is screw connected to a presser drive member 15.

The pressure receiving member 9 is constituted by a disk 9*a* and a boss 9*b* put together. The disk 9*a* is formed on the side plate 1*b* side and the boss 9*b* is formed in a way to protrude to the presser drive member 15 side. On the boss 9*b*, a ratchet wheel 10 and a pair of frictional members 11, 11 are held rotatably by a round hole provided at their center. The ratchet wheel 10 is provided for prevention of reverse rotation while the pair of frictional members 11, 11 get in contact with the both faces of the ratchet wheel 10 in a way to be pressed against the latter.

The ratchet wheel 10 and the pair of frictional members 11, 11 are pressed against the disk 9*b* of the pressure receiving member 9 by the pressing force in axial direction of the presser drive member 15. Between the pressure receiving member 9 and the presser drive member 15, a reinforcing spring 16 is provided. The reinforcing spring 16 adds a force in a direction to separate the pressure receiving member 9 and the presser drive member 15 from each other, and the presser drive member 15 presses the ratchet wheel 10 and the pair of frictional members 11, 11 against the disk 9*b* of the pressure receiving member 9 in resistance to the force of the reinforcing spring 16. The ratchet 12 is supported by a shaft 13 protruding from the side plate 1*b* and is linked with the ratchet wheel 1 by the springy force of a resilient 14 mounted on the shaft 13. This enables the ratchet wheel 10 to rotate only in the direction of lifting of the load sheave 2. The ratchet wheel 10, the pair of frictional member 11, 11 and the ratchet 12 constitute a drive force transmission mechanism which transmits the rotational force in the direction of lifting of the presser drive member 15 to the pressure receiving member 9.

The presser drive member 15 forms on its external end face a first boss 15*a* of a large diameter and a second boss 15*b* of a small diameter is formed on the end face of the first boss 15*a*. On the circumferential face of the first boss 15*a*, a plural number (3 pieces in the illustrated example) of notches 15*c* are provided at equal intervals in the circumferential direction. On the circumferential face of the second boss 15*b*, a male screw 15*d* is formed.

A conical frictional member 17 is hollow and its circumferential face is formed in a conical face having a prescribed vertical angle. At the end on the small diameter side of this conical frictional member 17, a collar 17*d* is formed inwardly in the radial direction and a round hole 17*a* is formed at the inner end of this collar 17*d*. The first boss 15*a* of the presser drive member 15 is inserted in the round hole 17*a*. On the inner circumferential face of this round hole 17*a*, a plurality of projections 17*b* are provided. Those projection 17*b* are connected respectively with the notches 15*c*, 15*c*,—provided on the first boss 15*a* to constitute a spline connection. On the other hand, at the end face on the large diameter side of the conical frictional member 17, three cutouts 17*c* in axial direction are provided at equal intervals in the circumferential direction.

The conical frictional member 17 is fitted in a conical hole 18*b* of a rotational force transmitting member 18 and is pressed inwardly in the axial direction by a reinforcing member 19. On the circumferential face of the rotational force transmitting member 18, a gear 18*a* is formed. The reinforcing member 19, which is either a belleville spring or a coil spring, is mounted on the second boss 15*b* of the presser drive member 15 in the internal space of the conical frictional member 17 and is in contact at its circumferential edge with the inward collar 17*d* of the conical frictional member 17. The reinforcing member 19 is tightened by a nut member 20 screw connected to the second boss 15*b* and the conical frictional member 17 is pressed inwardly in the axial direction. As a result, the conical face of the conical frictional member 17 and that of the rotational force transmitting member 18 are put in frictional contact with each other. And, with an adjustment of the tightening quantity by the nut member 20, the pressing force of the conical frictional member 17 is set and the value of the rated load to be hung on the load sheave 2 is set accordingly.

On the large diameter side of the conical frictional member 17, an operating wheel 21 is connected by spline to a spline 4*c* formed on the drive shaft 4. The operating wheel 21 is prevented from falling from the drive shaft 4 by a nut 22. The nut 22 is screw connected to a small diameter screw 4*d* formed at the small diameter part at the tip of the drive shaft 4. On the operating wheel 21, a projection for connection 21*a* is provided facing the large diameter side of the conical frictional member 17. This projection for connection 21*a* is connected to one of the concavities for connection 17*c*, 17*c*,—of the conical frictional member 17. The length in the circumferential direction of the projection 21*a* of the operating wheel 21 is short compared with the length in the circumferential direction of the cutouts 17*c*, 17*c*,—of the conical frictional member 17. For that reason, when the operating wheel 21 is rotated in the lowering direction together with the drive shaft 4 and the conical frictional member 17 is rotated in the lowering direction at a rotational speed slightly slower than the drive shaft 4, the conical frictional member 17 moves to the pressure receiving member 9 side along the drive shaft 4 until the time when the projection 21*a* of the operating wheel 21 contacts the side wall of the cutouts 17*c* of the conical frictional member 17. This is because the conical frictional member 17 rotates in unison with the presser drive member 15 and the rotational force transmitting member 18 while the presser drive member 15 relatively rotates against the right-handed screw 4*b* of the drive shaft 4 and progresses spirally on this right-handed screw 4*b*.

On the surface side of the side plate 1*b*, a brake cover 23 is mounted. This brake cover 23 covers the entire part of the pressure receiving member 9, the ratchet wheel 10 and the ratchet 12 and covers a part of the presser drive member 15. At one end of the brake cover 23, a flange 23*a* is formed and this part of flange 23*a* is screwed to the side plate 1*b*. On the other end of the brake cover 23, a cylindrical part 23*b* is formed. The cylindrical part 23*b* is located close to the circumferential face of the presser drive member 15.

The cylindrical part 23*b* holds an operating lever 24 rotatably against both the brake cover 23 and the operating wheel 21. The operating lever 24 drives the presser drive member 15 to rotate in either the lifting direction or the lowering direction through the rotational force transmitting member 18 and the conical frictional member 17. This operating lever 24 consists of an inner cover 24A and an outer cover 24B of steel, the outer cover 24B being fitted on the outside of the inner cover 24A and the peripheral part of those two covers being connected to each other by means of a plural number of bolts 25. The peripheral cover of those two covers 24A and 24B covers the entire part of the rotational force transmitting member 18.

In the inner cover 24A, an inner cylindrical part **24*a* is provided facing the cylindrical part 23*b* of the brake cover 23 and this inner cylindrical part 24*a* is inserted in the inner side of the cylindrical part 23*b* and held there in a rotatable condition. A connecting member 26 prevents disconnection with the brake cover 23. This connecting member 26 is mounted on the inner face of the inner cylindrical part 24*a* and is bent to the cylindrical part 23*b* side of the brake cover 23**.

On the outside in axial direction of the outer cover 24B, an outer cylindrical part **24*b* is formed. The outer cylindrical part 24*b* covers the connecting portion of the concavities for connection 17*c* of the conical frictional member 17 and the projection for connection 21*a* of the operating wheel 21**.

Inside the operating lever 24 is mounted a rotational direction selecting claw 27. The rotational direction selecting claw 27 switches the rotational direction of the rotational force transmitting member 18, the conical frictional member 17 and the presser drive member 15 to either lifting direction or lowering direction.

The rotational direction selecting claw 27 is fixed to a supporting shaft 28. The supporting shaft 28 is held rotatably by the operating lever 24 and protrudes at one end to outside from the operating lever 24. This protruding part of the supporting shaft 28 is provided with a handle 29 for switching.

With a rotational operation of this handle 29, the rotational direction selecting claw 27 is selectively switched to two connecting positions (lifting position and lowering position) to be connected to the gear **18*a* of the rotational force transmitting member 18 and to a neutral position not to be connected to the gear 18*a*. At the two connecting positions, the reciprocating rotational operation of the operating lever 24 is transmitted to the rotational force transmitting member 18 through the rotational direction selecting claw 27. For that reason, the rotational force transmitting member 18 rotates the presser drive member 15 in either the lifting position or the lowering position through the conical frictional member 17. On the other hand, at the neutral position, the rotational force transmitting member 18 does not turn in any direction because it is disconnected from the rotational direction selecting claw 27 of the operating lever 24**.

The lower end part of the rotational direction selecting claw 27 is pressed springily upward by a positioning member 30 reinforced by a coil spring 31. And, under the pressing force of the coil spring 31, the rotational direction selecting claw 27 is held springily at either the two connecting positions or the neutral position.

An upper hook 33 for lifting the hoist body 1 is attached to a connecting shaft 32 which connects the side plates **1*a*, 1*b*. A lower hook 35 for lifting the baggage is provided at the lower end of the load chain 34**.

Next, description will be given hereunder of the motion of the lever type hoist constructed as above.

Lifting Motion

If you move the operating lever 24 in two ways under the state that the rotational direction selecting claw 27 is switched to the lifting position, the rotational force transmitting member 18 will rotate the conical frictional member 17 in the lifting direction through a conical face contact with the conical frictional member 17 due to the pressing force of the reinforcing member 19 within the established rated load. This rotational force is transmitted to the presser drive member 15 with the connection between the convexities for connection **17*b* of the conical frictional member 17 and the notches 15*c* of the presser drive member 15. And the presser drive member 15 spirally progresses to inside in axial direction on this right-handed screw 4*b* of the drive shaft 4 to rotate the pressure receiving member 9 in unison through the ratchet wheel 10 and the frictional members 11, 11 on both sides, causing the drive shaft 4 to rotate in the lifting direction (clockwise direction seen from the operating wheel 21 side). The rotational force of the drive shaft 4 is transmitted to the load sieve 2 through the geared transmission system 8 connected with the pinion 6 at one end of the drive shaft 4. The load sieve 2 rotates in the same direction as the drive shaft 4. As a result, the baggage within the rated load hung at the lower hook 35 of the load chain 34 is hoisted by the two-way operation of the operating lever 24**.

On the other hand, in the case where a baggage in excess of the rated load is hung at the lower hook 35, sliding is produced between the rotational force transmitting member 18 and the conical frictional member 17 even if you make a two-way operation of the operating lever 24, making it impossible to rotate the conical frictional member 17 in the lifting direction. As a result, the drive shaft 4 and the load sheave 2 are not rotated in the lifting direction and lifting of a baggage in excess of the rated load is automatically prevented to maintain the safety of work.

Lowering Motion

On the other hand, if you move the operating lever 24 in two ways under the state that the rotational direction selecting claw 27 is switched to the lowering position, the presser drive member 15 will be made to move in the direction not to press the ratchet wheel 10 and the frictional members 11, 11 by the rotational force transmitting member 18 and the conical frictional member 17, allowing the pressure receiving member 9 and the drive shaft 4 to turn in the lowering direction by a certain angle against the ratchet wheel 10. As a result, the baggage within the rated load hung at the lower hook 35 will be lowered intermittently with repetitions of two-way operations of the operating lever 24.

Free Rotational Motion

If you switch the rotational direction selecting claw 27 to the neutral position and pull the end side of the load chain 34 under the no-load condition where no baggage is hung on the lower hook 35, you can make a free rotation of the load sheave 2 smoothly with a small pulling force.

Namely, if you turn the load sheave 2 by pulling the end side of the load chain 34, the drive shaft 4 is also rotated in the same direction by the geared transmission system 8 which is engaged with the gear 7 of the load sheave 2. However, even if the drive shaft 4 rotates, the presser drive member 15 is rotated at a speed somewhat slower than the drive shaft 4 because it is pressed outwardly in the axial direction by the reinforcing member 16 mounted between the presser drive member 15 and the pressure receiving member 19 and its frictional force with the frictional members 11 is small. For that reason, the presser drive member 15 screw connected with the right-handed screw **4*b* of the drive shaft 4 is moved toward the operating wheel 21 together with the conical frictional member 17 which is linked with the notch 15***c* of the first boss 15*a*. As a result of this movement, the rotational force transmitting member 18 which is in contact with both the presser drive member 15 and the conical frictional member 17 also moves toward the operating wheel 21 to come closer to the inner face of the external cover 24B of the operating lever 24 and other component members.

However, before this rotational force transmitting member 18 gets in contact with the inner face of the external cover 24B of the operating lever 24 and other component members, the projection for connection 21*a* of the operating wheel 21 which rotates in unison with the drive shaft 4 contacts the side wall of the contacts 17*c* of the conical frictional member 17. As a result, the conical frictional member 17, the rotational force transmitting member 18 and the presser drive member 15 are rotated in the same direction and at the same speed as the drive shaft 4, thus preventing the rotational force transmitting member 18 from moving outwardly in the axial direction along the drive shaft 4.

Consequently, when you switch the rotational direction selecting claw 27 to the neutral position and pull the end side of the load chain 34, the presser drive member 15 is maintained in a state not to get in contact with the inner face of the external cover 24B of the operating lever 24, etc. and, as a result, it becomes possible to make a smooth free rotation of the load sieve 2 continuously with a small pulling force.

This invention provides excellent operating characteristics as described below.

The conical face of the conical frictional member connected to the presser drive member is put in frictional contact in the conical hole of the rotational force transmitting member by a pressing force set by a reinforcing member. For that reason, if the baggage hung at the lower hook of the load chain has become heavier than the rated load, the rotational force transmitting member runs idle as it cannot rotate the conical frictional member and the presser drive member on which a load larger than the rated load is acting, even if you try to rotate the rotational force transmitting member in the lifting direction. Consequently, lifting of a baggage heavier than the rated load is automatically prevented to ensure the safety of work.

Moreover, in a case where the rotational force transmitting member is moved outwardly in the axial direction along the drive shaft together with the presser drive member and the conical frictional member connected to it, the concavity for connection on the large diameter side of the conical frictional member and the projection for connection of the operating wheel facing it are positioned in such a way as to get in touch with each other before the rotational force transmitting member gets in contact with the external cover of the operating lever and other component members. For that reason, in a case where you switch the rotational direction selecting claw to the neutral position and pull the end side of the load chain under the no-load condition, the rotational force transmitting member also rotates in unison with the drive shaft by the operating wheel before it gets in contact with the external cover of the operating lever and other component members. Therefore, it becomes possible to make a smooth free rotation of the load sieve continuously with a small pulling force, thus enabling a rapid movement of the lower hook.

The concrete example given in the section of the detailed description of the invention is intended to clarify the content of technology of the invention. Therefore, this invention should not be interpreted in a narrow sense as restricted to the above-mentioned concrete example only but shall be interpreted in a broad sense as available for embodiment with various modifications within the range of the spirit of this invention and the claims.

What is claimed is:

1. A lever type hoist comprising a drive shaft connected to a load sheave through a geared transmission system, a pressure receiving member fixed on the drive shaft, a presser drive member threaded on the drive shaft for movement in the axial direction when rotated relative to said drive shaft, driving force transmission means between the presser drive member and the pressure receiving member for transmitting rotational force in the lifting direction of the load sheave from the presser drive member to the pressure receiving member, a conical frictional member comprising means for connection thereof with the presser drive member in the axial movement thereof and having an external conical face, a rotational force transmission member having a conical hole for selective frictional contact with the external conical face of the conical frictional member and having means for connection with an operating lever, an operating wheel non-rotationally connected by splines to the drive shaft and being close to the conical frictional member, the operating wheel and the conical frictional member comprising means for rotational connection thereof in the direction of rotation in a first axial position of said conical friction member and for disconnection thereof in a second axial position of said conical friction member, and means for causing, when the load sheave is rotating freely, rotational connection of said operating wheel and said conical friction member before the rotational force transmitting member moves in the axial direction to engage other component members of said hoist.

2. The lever type hoist as claimed in claim 1, wherein the driving force transmission means comprises a ratchet wheel and a pair of frictional members engageable with the opposite faces of the ratchet wheel, and means for permitting rotation of said ratchet wheel in one direction only.

3. The lever type hoist as claimed in claim 2, wherein the presser drive member is axially spaced from the pressure receiving member with the ratchet wheel and the pair of frictional members interposed between them and a spring urging said presser drive member away from the pressure receiving member.

4. The lever type hoise as claimed in claim 1, wherein said presser drive member has a plurality of notches at equal circumferential intervals on the circumferential face thereof, and said conical frictional member has a plurality of projections for engaging said notches.

5. The lever type hoist as claimed in claim 1, wherein the means for connection of the conical friction member with the presser drive member comprises a reinforcing member, and means for pressing said reinforcing member against said conical friction member to cause the external conical face of the conical frictional member to be pressed by a prescribed pressing force in the axial direction into frictional contact with the inner face of the conical hole of the rotational force transmitting member, said pressing means comprising a threaded boss on the presser drive member and a nut member threaded thereon.

6. The lever type hoist as claimed in claim 1, wherein the means for rotational connection of the operating wheel and the conical frictional member comprises a cutout and a projection, the length in the circumferential direction of the projection being short compared with the length in the circumferential direction of the cutout.

7. The lever type hoist as claimed in claim 6, wherein on the large diameter end of the conical frictional member there are a plurality of cutouts at equal intervals in the circumferential direction and wherein said projection is on the operating wheel, for engagement in any of the cutouts.

8. A lever type hoist comprising:

a load sheave, a pair of side plates on either side of said load sheave, a drive shaft extending through said side plates and said load sheave, a transmission system having a plurality of gears and comprising a first said gear fixed to said drive shaft, a pressure receiving member fixed to said drive shaft, a ratchet wheel on said pressure receiving member, means for preventing reverse rotation of said load sheave comprising a ratchet wheel on said pressure receiving member, and friction members on either side of said ratchet wheel, one said friction member being between said ratchet wheel and a portion of said pressure receiving member, a presser drive member engageable with the other of said friction members, means mounting said presser drive member for axial movement on said drive shaft for engaging a said friction member in one position of said presser drive member for applying force through said engaged friction member to said ratchet wheel, said other friction member and said pressure receiving member, spring means for urging said presser drive member away from said pressure receiving member, an operating lever, a conical friction member carried by said presser drive member, a rotatable force transmission member connected with said operating lever and being adjacent said presser drive member and said conical frictional member for transmitting its rotational force to said conical friction member, means for pressing said conical friction member against said rotational force transmission member comprising a nut member threaded on the presser drive member, and a reinforcing member engaged by said nut member and in engagement with said conical frictional member, an operating wheel spline-connected to said drive shaft and in proximity to said conical frictional member, means on said conical frictional member and said operating wheel comprising at least on projection and at least one cutout for selectively providing a rotational driving connection between said operating wheel and said conical frictional member, and means for causing a said projection and a said cutout to be drivingly engaged before movement of the rotational force transmission member in the outward axial direction by the presser drive member causes engagement of the operating wheel with an axial cover or other component of said hoist.

* * * * *